United States Patent [19]

Lin

[11] Patent Number: 5,069,617

[45] Date of Patent: Dec. 3, 1991

[54] WAX-ACCUMULATED MUSICAL CANDLE

[76] Inventor: Wen-Tsung Lin, P.O. Box 74-9, Taipei, Taiwan

[21] Appl. No.: 712,142

[22] Filed: Jun. 6, 1991

[51] Int. Cl.[5] ..... F23D 3/16

[52] U.S. Cl. ..... 431/253; 431/292

[58] Field of Search ..... 431/253, 292

[56] References Cited

U.S. PATENT DOCUMENTS 5,015,175 5/1991 Lee ..... 431/253

*Primary Examiner*—Carroll B. Dority

[57] ABSTRACT

A musical candle includes: a candle having at least a draining trench recessed in the candle fluidically communicated with a central wick hole secured with a wick therein, a holder casing for mounting the candle in the casing and for storing a musical integrated circuit for a sounding operation of the musical candle in the casing, and a wax accumulator formed in the holder casing for collecting paraffin oil drained from a molten wax stream flowing through the trench in the candle, thereby preventing a drainage of molten oil from the candle wax towards a table surface for preventing an oil contamination on the table surface.

5 Claims, 4 Drawing Sheets

WAX-ACCUMULATED MUSICAL CANDLE

BACKGROUND OF THE INVENTION

A conventional musical candle as shown in FIG. 1 includes a candle 1 having a wick 2 formed in a central portion of the candle 1, a musical integrated circuit 3 operatively actuated by a burning of the wick 2, and a casing 4 for mounting the candle 1 in the casing 4. After the burning of the candle 1, a paraffin wax will be melted to "tear down" as shown in a numeral 1*a* which will drop to a table surface to cause contamination.

The present inventor has found the drawbacks of a conventional musical candle and invented the present musical candle for preventing leakage of wax from a burning candle.

SUMMARY OF THE INVENTION

The object of the present invention is to provide a musical candle including: a candle having at least a draining trench recessed in the candle fluidically communicated with a central wick hole secured with a wick therein, a holder casing for mounting the candle in the casing and for storing a musical integrated circuit for a sounding operation of the musical candle in the casing, and a wax accumulator formed in the holder casing for collecting paraffin oil drained from a molten wax stream flowing through the trench in the candle, thereby preventing a drainge of molten oil from the candle wax towards a table surface for preventing an oil contamination on the table surface.

DETAILED DESCRIPTION

Figure 1:
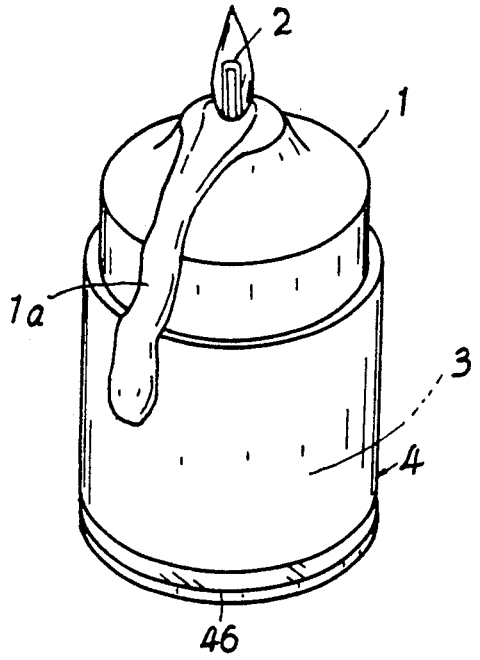
PRIOR ART FIG.1
FIG. 1 is a prior art showing a conventional musical candle.
Figure 2:
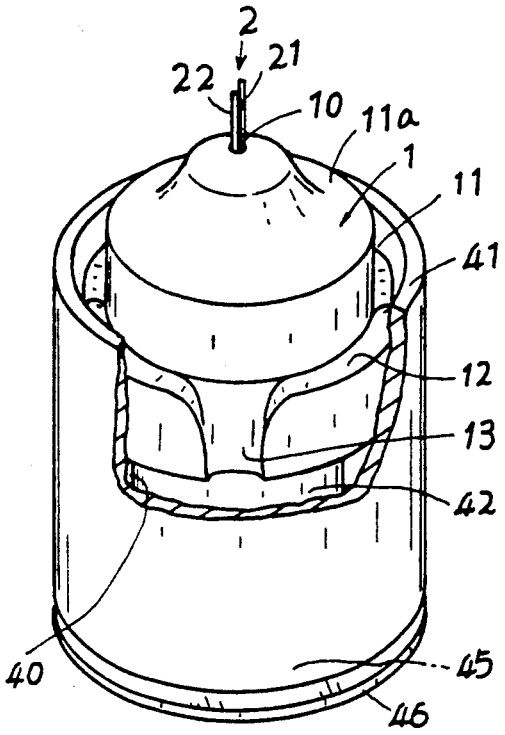
FIG. 2 is a partial cut-away perspective view of the present invention.
Figure 3:
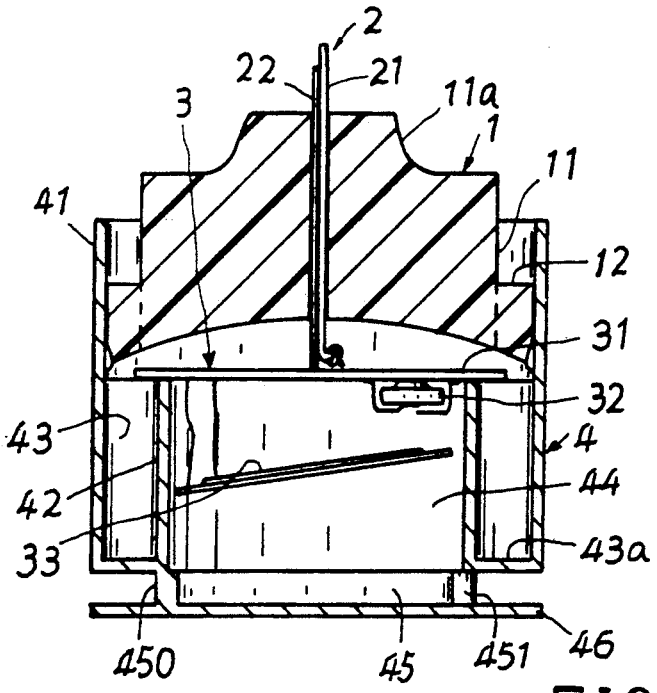
FIG. 3 is a sectional drawing of the present invention as shown in FIG. 2.
Figure 4:
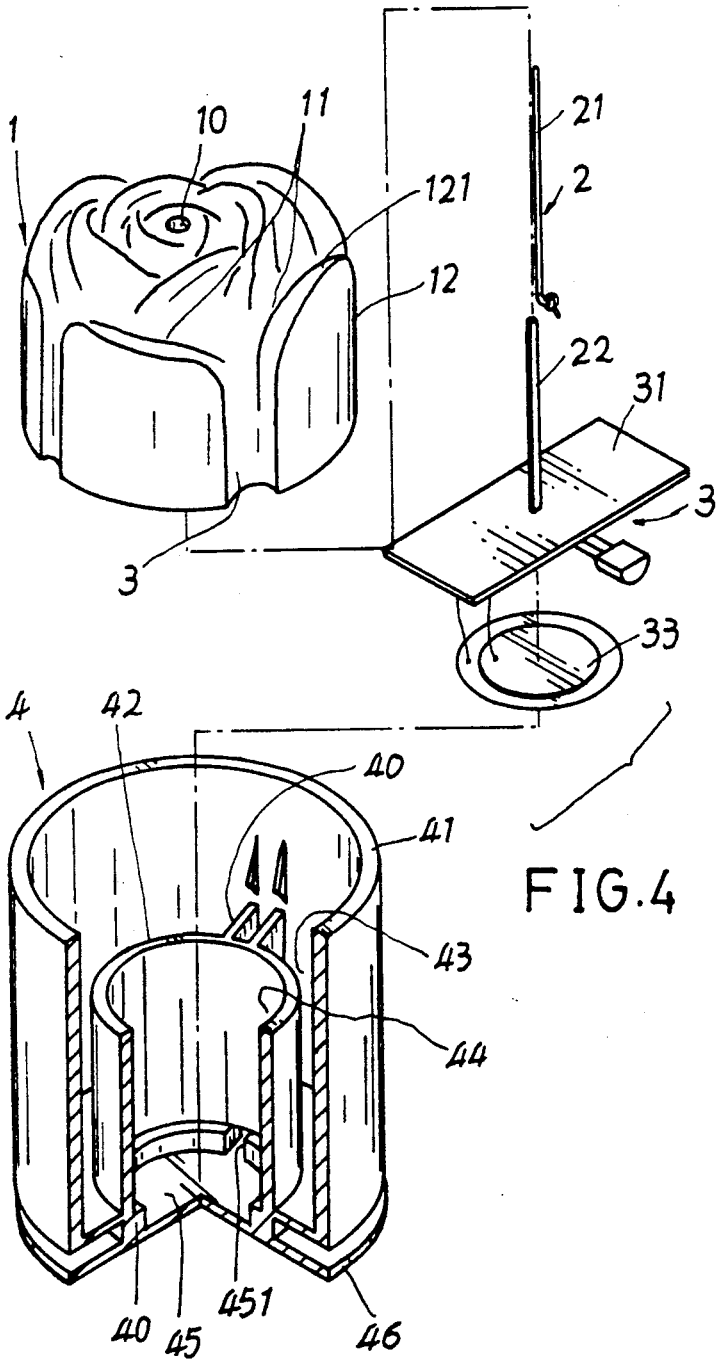
FIG. 4 is an exploded view showing all parts in construction of another preferred embodiment of the present invention.
Figure 5:
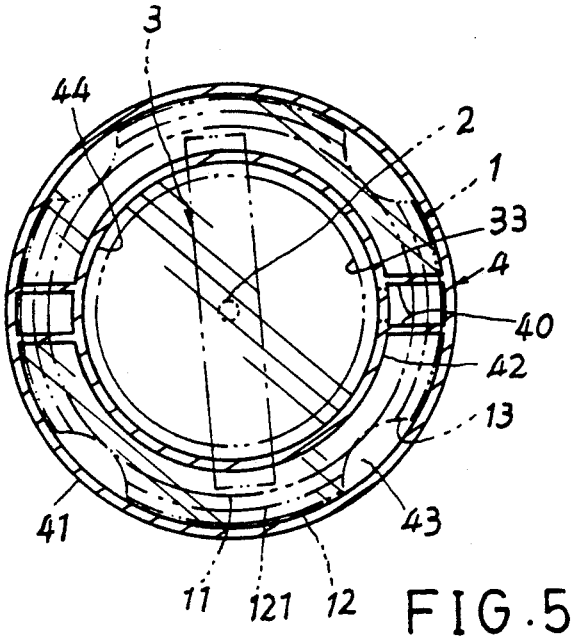
FIG. 5 is a top view cross sectional drawing of the present invention as shown in FIG. 4.
Figure 6:
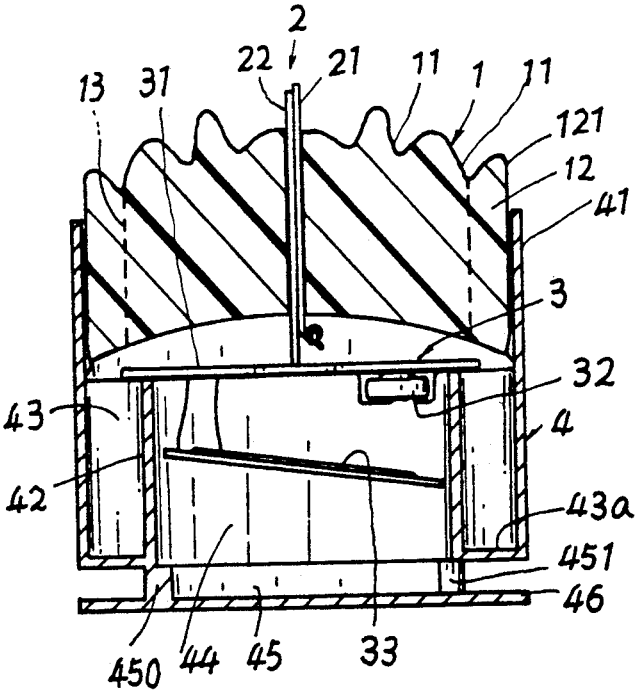
FIG. 6 is a side view sectional drawing of the present invention as shown in FIG. 5.

As shown in FIGS. 2, 3, the present invention comprises: a candle 1, a wick means 2, a musical integrated circuit 3, and a holder casing 4. The shape of the present invention is not limited, but preferably a cylindrical shape.

The candle 1 includes a wick hole 10 longitudinally formed in a central portion of the candle 1 for mounting the wick means 2 in the wick hole 10, a draining trench 11 circumferentially recessed in an outer periphery of the candle 1 within an outer wall 41 of the holder casing 4, a plurality of side block portions 12 formed on a circumferential surface of the candle 1 engageably secured in the outer wall 41, and a plurality of draining slots 13 each slot 13 formed between two neighbouring side block portions 12 communicated with the trench 11. The trench 11 is adjacent to a sloping surface 11*a* tapered downwardly from a central top portion of the candle 1.

The wick means 2 includes a wick 21 juxtapositionally combined with a sensor 22 which may be selected from an optical fiber sensor 22 as shown in Ruzek's U.S. Pat. No. 4,477,249 or a thermistor as shown in applicant's early granted U.S. Pat. No. 4,983,119 for operatively sensing a burning wick 21 for actuating the musical integrated circuit 3 for playing music.

The musical integrated circuit 3 includes: a printed circuit board 31 having integrated circuits formed on the board 31, a dry battery 32 powering the integrated circuit 3, and a buzzer 33 for music sounding purpose.

The holder casing 4 includes: an outer wall 41 formed on an outer portion of the casing 4, an inner wall 42 formed on an inner portion of the casing 4, a wax accumulator 43 defined between the outer wall 41 and the inner wall 42 and a closed bottom portion 43*a* formed on a bottom portion between the two walls 41, 42, a central socket 44 defined within the inner wall 42 for storing the musical integrated circuit 3 in the socket 44, a resonance chamber 45 formed in a lower portion of the casing 4 having a bottom extension 450 secured to the bottom portion 43*a* of the accumulator 43, and a base portion 46 secured under the bottom extension 450 overlain on a table surface.

The bottom extension 450 is formed with a plurality of sound passages 451 for transmitting sound outwardly from a sounding buzzer 33 of the musical integrated circuit 3 formed in the central socket 44 of the casing 4. The buzzer 33 may be engageably mounted on the bottom extension 450.

In using the present invention for burning the candle 1, the burned or illuminated wick 21 will be sensed by the sensor 22 to actuate the musical integrated circuit 3 for sounding the same of which the sound waves will be transmitted outwardly through sound passages 451 formed in the resonance chamber 45 for entertaining the candle user. The molten wax or oil from the burned wick 2 will flow downwardly through the sloping surface 11*a*, the trench 11 to be drained through the slots 13 formed between the block portions 12 and finally accumulated in the accumulator 43, thereby preventing a random flow or leakage of the wax oil for enhancing a decorative appearance and preventing pollution therefore.

For reinforcing purpose, several reinforcing ribs 40 are provided to firmly connect the inner and outer walls 42, 41.

Another preferred embodiment of the present invention is to provide a musical candle imitating a flower having plural petals surrounding the central wick means 2 includes a plurality of draining trenches 11 recessed in an upper portion of the candle 1 communicated with the central wick means 2, a plurality of side block portions 12 circumferentially formed on a periphery of the candle 1 engageably inserted in the outer wall 41 of the casing 4, and a plurality of draining slots 13 each slot 13 recessed inwardly towards the central wick hole 10 communicated with the trenches 11.

Each side block portion 12 is formed with a ridge portion 121 protruding upwardly from the side block portion 12 serving as a dike or barrier of the trench 11 to prevent an overflow leakage of the wax oil.

The wax oil when burning the wick means 2 of the candle 1 will flow through the trenches 11, the slots 13 to be drained into the accumulator 43 defined between the two walls 41, 42 and the closed bottom 43*a* to prevent an overflow leakage and contamination of a table or object surface. The ridge portion 121 will prevent an oil leakage from the trench 11. The wax oil is then drained into the accumulator 43 through the slot 13 generally vertically recessed in the cylindrical surface of the candle 1, without being leaked outwardly over the outer wall 41.

The oil stored in the accumulator 43 will not penetrate into the central socket 44 to prevent erosion or heat damages, hazardous to the electronic parts of the integrated circuit 3.

What is claimed is:

1. A musical candle comprising:

a candle having a wick means longitudinally formed in said candle, a musical integrated circuit secured with the candle operatively actuated by a burning of said wick means, and a holder casing for mounting said candle and said musical integrated circuit in said casing;

said candle having means for draining a molten wax or oil when burning the candle into a wax accumulator formed in said casing, thereby preventing an oil leakage or contamination of the molten wax from the candle towards a table surface.

2. A musical candle according to claim 1, wherein said candle includes a wick hole longitudinally formed in a central portion of the candle for mounting the wick means in the wick hole, at least a draining trench circumferentially recessed in an outer periphery of the candle within an outer wall of the holder casing, a plurality of side block portions formed on a circumferential surface of the candle engageably secured in the outer wall, and a plurality of draining slots each slot formed between two neighbouring side block portions communicated with the trench adjacent to a sloping surface tapered downwardly from a central top portion of said candle.

3. A musical candle according to claim 1, wherein said holder casing includes: the outer wall formed on an outer portion of the casing, an inner wall formed on an inner portion of the casing, the wax accumulator defined between the outer wall and the inner wall and a closed bottom portion formed on a bottom portion between the said two walls, a central socket defined within the inner wall for storing the musical integrated circuit in the socket, a resonance chamber formed in a lower portion of the casing having a bottom extension secured to the closed bottom portion of the accumulator, and a base portion secured under the bottom extension overlain on a table surface, said bottom extension formed with a plurality of sound passages for transmitting sound outwardly from a sounding buzzer of the musical integrated circuit formed in the central socket of the casing.

4. A musical candle according to claim 1, wherein said candle includes a plurality of draining trenches recessed in an upper portion of the candle communicated with the central wick means, a plurality of side block portions circumferentially formed on a periphery of the candle engageably inserted in the outer wall of the casing, and a plurality of draining slots each said slot recessed inwardly towards the central wick hole communicated with the trenches, each said side block portion formed with a ridge portion protruding upwardly from the side block portion serving as a dike or barrier for the trench to prevent an overflow leakage of wax oil.

5. A musical candle according to claim 4, wherein said candle is formed to imitate a flower with a plurality of petals having said plurality of said trenches recessed in between said petals of a flower.

* * * * *